US007451823B2

(12) United States Patent
Wilson

(10) Patent No.: US 7,451,823 B2
(45) Date of Patent: Nov. 18, 2008

(54) WELL CHEMICAL TREATMENT UTILIZING PLUNGER LIFT DELIVERY SYSTEM WITH CHEMICALLY IMPROVED PLUNGER SEAL

(75) Inventor: Dennis Ray Wilson, Aztec, NM (US)

(73) Assignee: ConocoPhillips Company, Houston, TX (US)

( * ) Notice: Subject to any disclaimer, the term of this patent is extended or adjusted under 35 U.S.C. 154(b) by 38 days.

(21) Appl. No.: 11/466,370

(22) Filed: Aug. 22, 2006

(65) Prior Publication Data

US 2007/0039739 A1 Feb. 22, 2007

Related U.S. Application Data

(63) Continuation-in-part of application No. 10/630,292, filed on Jul. 30, 2003, now Pat. No. 7,117,947.

(51) Int. Cl.
*E21B 43/16* (2006.01)

(52) U.S. Cl. ..... 166/372; 166/90.1

(58) Field of Classification Search ..... 166/372, 166/68, 105, 90.1, 75.15
See application file for complete search history.

(56) References Cited

U.S. PATENT DOCUMENTS

| | | | |
|---|---|---|---|
| 2,074,912 | A | 3/1937 | Hutto |
| 2,654,436 | A | 10/1953 | Carlisle et al. |
| 2,884,067 | A | 4/1959 | Marken |
| 3,090,316 | A | 5/1963 | Montgomery |
| 3,090,912 | A | 5/1963 | Ruoff |
| 3,412,798 | A | 11/1968 | Gregston |
| 3,473,611 | A | 10/1969 | Gregston |
| 3,901,313 | A | 8/1975 | Doniguian et al. |
| 4,347,899 | A | 9/1982 | Weeter |
| 4,354,553 | A | 10/1982 | Hensley |
| 4,629,004 | A | 12/1986 | Griffin |
| 4,817,722 | A | 4/1989 | Montfort, Jr. et al. |

(Continued)

FOREIGN PATENT DOCUMENTS

WO WO 2008/024547 A2 2/2008

OTHER PUBLICATIONS

S. Farris, "Chemical Deployment System for Plunger Lift Completions", Gas Well De-Liquification Workshop, Denver, Colorado, Feb. 27-Mar. 1, 2006, 22 pages.

(Continued)

*Primary Examiner*—William P Neuder
(74) *Attorney, Agent, or Firm*—Nathanael G. Barnes; Ryan N. Cross

(57) ABSTRACT

An apparatus incorporating a chemical seal and method for removing fluids from a well is disclosed. The chemical seal is created by a foaming agent which, when in the presence of gas and fluids present in the well, and when agitated by the apparatus, creates foam between the apparatus and the walls of the well in which it operates. The foam improves the seal between the apparatus and the inner wall of the well, improving the efficiency of the apparatus in lifting fluids from the well. Furthermore, the chemical seal improves the distribution of treatment chemicals within the well as it reduces liquid flowback. Automatic recharging or reapplication of the foaming agent and/or treatment chemicals to the apparatus can be accomplished with a chemical application assembly associated with the well.

17 Claims, 7 Drawing Sheets

U.S. PATENT DOCUMENTS

| | | | | |
|---|---|---|---|---|
| 4,921,048 | A | 5/1990 | Crow et al. | |
| 5,330,004 | A | 7/1994 | Williams et al. | |
| 5,343,941 | A | 9/1994 | Raybon | |
| 5,488,993 | A | 2/1996 | Hershberger | |
| 5,671,813 | A | 9/1997 | Lima | |
| 5,758,725 | A | 6/1998 | Streetman | |
| 6,209,637 | B1 | 4/2001 | Wells | |
| 6,279,656 | B1 | 8/2001 | Sinclair et al. | |
| 6,467,541 | B1 | 10/2002 | Wells | |
| 6,648,072 | B1 | 11/2003 | Blanchard | |
| 7,004,258 | B2 * | 2/2006 | Farris | 166/304 |
| 7,080,692 | B1 | 7/2006 | Kegin | |
| 7,117,947 | B2 * | 10/2006 | Wilson | 166/372 |

OTHER PUBLICATIONS http://www.fergusonbeauregard.com/lift.shtml, 2 pages.

The Univerisity of Tulsa, The Connector (A Quarterly Newsletter from the IPEC), Spring/Summer 2004, pp. 1-8, vol. 4, No. 2, Tulsa, Oklahoma.

Gary Covatch, "State-of-the-Art Technology Summary, Commercial Technologies Emerging from Stripper Well Consortium", 2004, pp. 1-4, vol. 10, 2nd Quarter, Morgantown, WV.

Gary Covatch, "Consortium Selects 13 New Projects to Aid Stripper Well Operators", Spring 2003, GasTIPS, 7 pages.

S. Farris, "Plunger Conveyed Chemical System for Plunger Lift Wells", Composite Engineers, Inc., compositeengineers@gbronline.com, 2 pages.

Well Master Corporation—The Plunger Lift System, http://wellmaster.com/PlungerLift/system.html, 3 pages.

Plunger Lift Equipment Manufacturer, Production Control Services, Inc., www.pcs.plungerlift.com, 10 pages.

Paul L. Ferguson et al., "Will Plunger Lift Work in My Well?", Southwestern Petroleum Short Course Association, 12 pages.

Stan Morrow et al., "Plunger Lift: Applications, Operations and its Effect on Measurement Systems", 5 pages.

Installing Plunger Lift Systems in Gas Wells, Natural Gas EPA Pollution Preventer, United States Environmental Protection Agency, Oct. 2003, 24 pages.

E. Beauregard et al., "New and Unusual Applications for Plunger Lift System", SPE 18868, Society of Petroleum Engineers, 8 pages.

E. Beauregard et al., "Introduction to Plunger Lift: Applications, Advantages and Limitations", Southwestern Petroleum Short Course Association, Apr. 23-24, 1981, 10 pages.

* cited by examiner

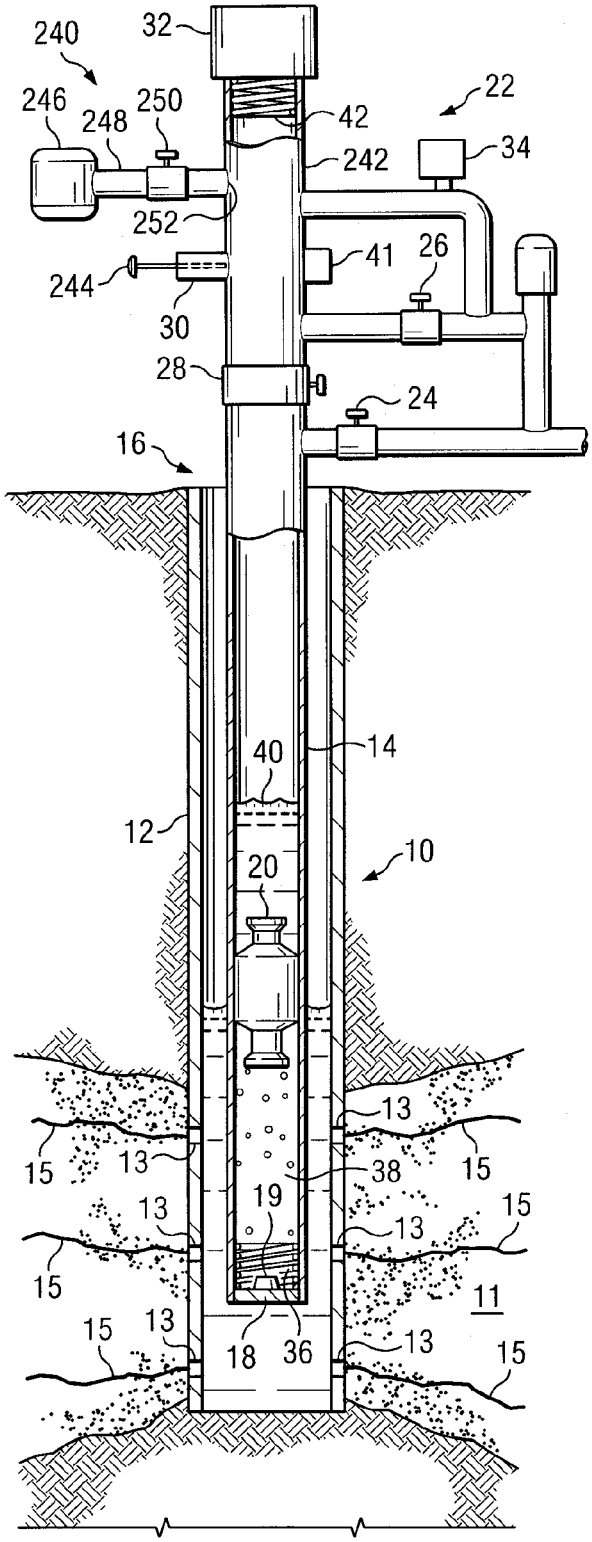
FIG. 1
FIG. 2A
(PRIOR ART)
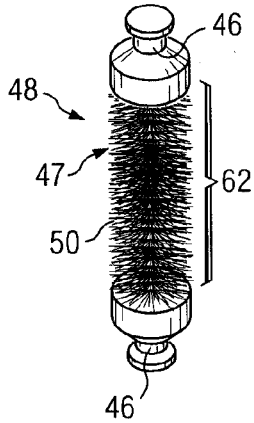
FIG. 2B
(PRIOR ART)
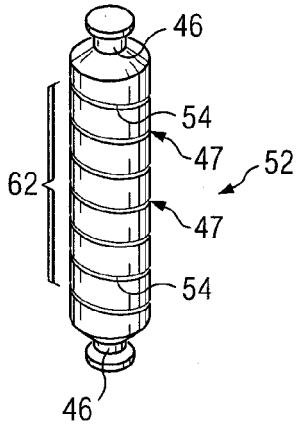
FIG. 2C
(PRIOR ART)
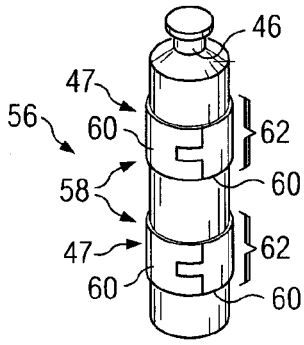

WELL CHEMICAL TREATMENT UTILIZING PLUNGER LIFT DELIVERY SYSTEM WITH CHEMICALLY IMPROVED PLUNGER SEAL

This is a continuation-in-part application of U.S. patent application Ser. No. 10/630,292 filed on Jul. 30, 2003.

TECHNICAL FIELD

The present invention relates to petroleum production and has significant application to wells which use plunger lift systems to aid in production from the well. In particular, the invention relates to an improved seal between a plunger used in a plunger lift system and the inside surface of the tubing in which the plunger travels.

BACKGROUND OF THE INVENTION

This invention relates to production from petroleum wells, and in particular, an improvement to the efficiency of plunger lift techniques and an improvement to the efficiency of chemical treatment of wells using plunger lift techniques. The invention will find use in wells which produce either gas or oil, including those using enhanced production techniques such as artificial gas lift. It is anticipated that the invention will find the greatest use in low producing or "stripper" wells, and more particularly in gas wells, thus, the background description and the description of the preferred embodiments of the invention will focus on gas wells.

As a well matures, the pressure in the formation decreases and the volume and velocity of the gas flow slows. While initially the flow rate and velocity of produced gas may be sufficient to remove the liquids with the gas, at some point the flow rate of gas will be insufficient to carry liquids out of the well. As a result, the liquid loading in the well will increase, and liquid will collect in the bottom of the well. When production by natural reservoir pressure becomes uneconomical, artificial lift techniques can be utilized to increase well production. A number of artificial lift systems are known in the industry, including sucker rod pumps, gas lift techniques and plunger lift techniques.

Conventional plunger lift systems, which are also known as free piston systems, utilize a plunger (piston) that is dropped into the well by releasing it from a plunger catcher located at the surface. The plunger falls to the bottom of the tubing and onto a bumper or stop at the bottom of the tubing. After the well is shut in and pressure in the well has built, the wellhead is opened to a low pressure line and the high pressure gas located within the well pushes the piston upward to the surface, thereby pushing the liquid on top of the plunger to the surface. This sequence can be repeated by closing the wellhead off and allowing the plunger to fall again to the bottom of the well while pressure in the well is allowed to rebuild. Another technique is the use of a bypass plunger which is designed so as not to require the well to be shut in. U.S. Pat. No. 6,209,637 entitled "Plunger Lift with Multi Piston and Method" relates to this technique.

Automatic control of plungers used in plunger lift technique is known in the art. Generally, an electronic controller can be utilized which is able to control all of the various valves required to open and close the well, monitor the position of the plunger, and catch the plunger at the surface. Such controllers may, for example use pressure within the well, production flow rate, or travel time of the plunger in order to determine when to perform various operations. Alternatively, an electronic controller may simply operate based on a preset, timed schedule. Electronic controllers are offered by Ferguson Beauregard of Tyler, Tex. and are described at Ferguson Beauregard's web site located at http://www.fergusonbeauregard.com/lift.shtml.

The efficiency of a plunger in bringing fluid to the surface is limited somewhat by the plunger's ability to create a seal with the inside walls of the tubing in which it travels. Ideally, to maximize the seal between the plunger and tubing, a plunger would have a diameter that is as close to the inside diameter of the tubing as possible, thereby minimizing gaps between the plunger and tubing. Unfortunately, obstructions may exist within the tubing, such as sand, crimping from work over operations, tool traps, and the like. Such obstructions could cause the plunger to become stuck in the tubing, thus a smaller diameter plunger may be selected. However, a smaller plunger may tend to leave a gap between the outer surface of the plunger and the inner surface of the production tubing. Thus, it is less able to create an effective seal with the tubing. As a result, when the plunger is rising in the well driving fluids out, these same fluids are able to pass around the sides of the plunger and fall back into the well.

Previous attempts to address this problem have achieved limited success. For example, attempts have been made to use a plunger fitted with a flexible rubber seal able to engage the walls of the tubing. U.S. Pat. No. 7,080,692 titled "Plunger Lift Tool and Method of Using the Same" to Kegin is illustrative of the rubber seal model. However, these plungers suffer from common drawbacks such as insufficient contact with the tubing, wear (particularly in the case of rubber seal plungers), and the inability to accommodate significant aberrations in the tubing. Thus, there is a need for a plunger which is able to travel in a well with a reduced risk of becoming stuck, while still being able to create an effective seal with the tubing walls.

Plunger lift assisted wells are known to be susceptible to corrosion, scale, and undesirable deposits of paraffin, petroleum distillates, asphaltines, microbial growth, and other undesirable substances. To address these problems, treatment chemicals such as soap, acid, corrosion inhibitors, solvents for paraffin and petroleum distillates, stabilizers, biocides and other known treatment chemicals are deposited downhole. A number of techniques have been employed to deliver these treatment chemicals, however, these techniques have many drawbacks, such as excessive chemical use, and inefficient application.

One treatment technique, known as continuous injection, involves the continuous pumping of treatment chemical into the annulus between the tubing and the casing, sometimes through capillary tubes. However, the treatment chemicals themselves are potentially damaging to the production tubing and/or casing, and the use of capillary tubes presents problems associated with installation and maintenance of the tubes themselves. Another treatment technique is a batch treatment technique. However, the batch technique does not provide even distribution of treatment chemical. Many batch and capillary treatment methods rely on the liquids accumulated in the wellbore to dilute the chemicals. As such, the chemicals are generally applied downhole in concentrated form. Unfortunately, the concentrated chemicals can be corrosive to the tubing and casing. Furthermore, in wells where the plunger does not make a good seal with the tubing, fluids which would have been forced out of the well by the plunger lift action will instead flow around the plunger and down the sides of the tubing, washing away treatment chemical, thereby raising the chemical dose necessary for effective treatment. The present invention provides an apparatus and method which is able to evenly distribute treatment chemicals along the inner surface of the tubing and minimize waste of treatment chemicals, damage to the tubing, and disruption to production from the well.

BRIEF DESCRIPTION OF THE DRAWINGS

The invention will be better understood with reference to the drawings taken in connection with the detailed description which follows:

FIG. 1 is a cross-sectional area of a well;

FIGS. 2A, 2B, and 2C are perspective illustrations of three prior art plungers;

The drawings illustrate certain preferred embodiments of the invention and like elements have been provided with like reference numerals to corresponding items between various drawings.

SUMMARY OF THE INVENTION

Figure 3:
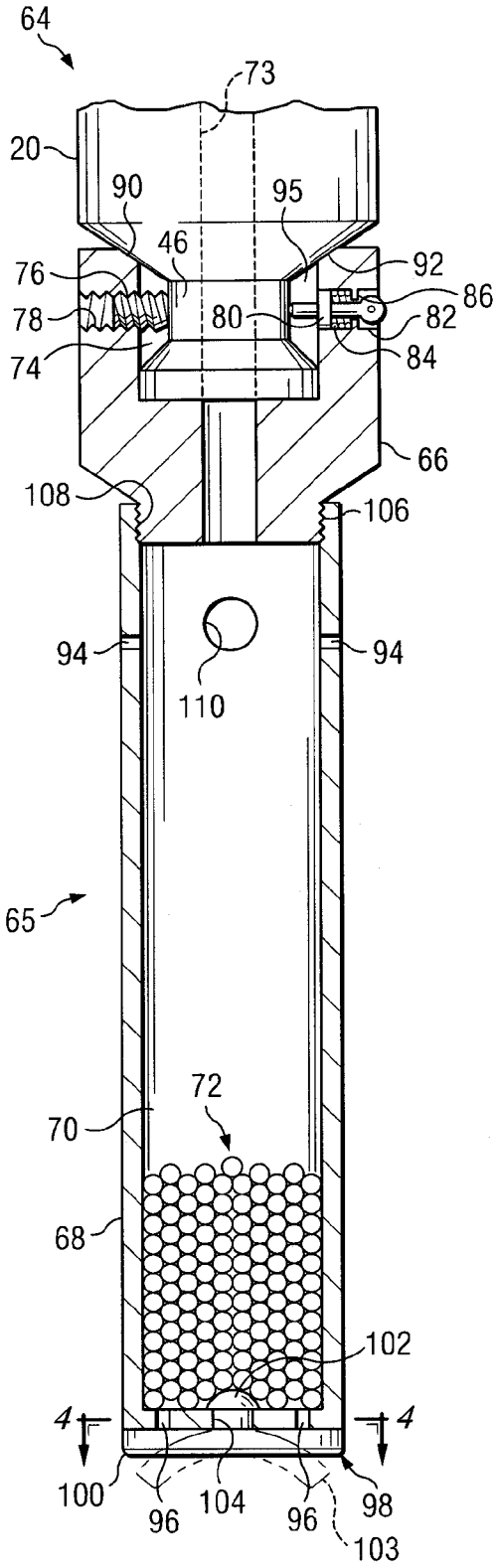
FIG. 3 is a cross-sectional view of a chemical dispenser removably attached to a plunger.

The present invention relates to a method and apparatus for creating an improved seal between a plunger and the inner wall of tubing inserted into a well wherein an artificial lift technique is used. In the method of the present invention, specific types of chemicals, referred to herein as foaming agents, known to produce foam in the presence of wellbore fluids, may be applied to a known plunger, such as a brush or pad plunger in the form of a gel, putty, paste or other suitable form such that a significant portion of the treatment chemical will be retained on the plunger as it is dropped from the well head to the bottom of the wellbore. While the plunger is at the bottom of its travel, foam builds around the plunger as the foaming agent diffuses and reacts with the produced liquids. The foaming may be augmented by produced or artificial lift gas as it bubbles through produced liquids at the bottom of the well. As the plunger returns to the surface, the foam acts as a seal, filling the gaps between the plunger and the inner surface of the tubing. When the plunger is caught in the plunger catcher, additional treatment chemical can be applied to the plunger before it is again dropped to the bottom of the wellbore, thereby ensuring that there will be foaming agent sufficient to create another foam seal on the plunger's next trip to the surface.

In another aspect, the invention relates to a method for improving the seal between the plunger or plunger/dispenser apparatus and the inside wall of the tubing in which it operates by using foaming agents which are surfactants or lubricants, or by adding surfactants or lubricants in addition to a foaming agent. The foam created by the foaming agent and/or mixtures of foaming agent with treatment chemical forms a chemical seal, creating a barrier between gas and liquids as the gas tries to bypass the plunger in an upward direction and as the liquid tries to fall backward between the outer surface of the plunger and the inside wall of the tubing. Thus, the invention may allow the plunger to bring a greater volume of fluids to the surface with each trip.

In another aspect, the present invention relates to a method and apparatus which provides more uniform distribution of treatment chemicals to the inside walls of the tubing inside the well. In particular, in addition to being treated with a foaming agent, the plunger may also have treatment chemical mixed with the foaming agent or be loaded with a treatment chemical. Alternatively, the foaming agent may itself be a treatment chemical. Once the plunger has been released into the well, it may treat the well during its downward travel. In addition, it will fall to the bottom of the well where it will encounter water and/or other fluids. A treatment chemical may then be released into the fluid, diluting it. As the plunger subsequently rises to the surface, the foaming agent will create foam which in turns forms a chemical seal which will force fluids mixed with the now diluted treatment chemicals ahead of it. In the present invention, because the plunger in combination with the foam and chemical seal more efficiently moves the fluid upward, the diluted treatment chemicals in the fluids may be more evenly applied to the inner walls of the tubing.

In another aspect, the plunger may be a plunger/dispenser apparatus. The apparatus includes an interface area and a dispenser section which includes one or more receptacles for receipt of treatment chemical. The plunger/dispenser may also have a neck for engagement with a plunger catcher, and/or downhole tools.

In yet another aspect, the chemical dispenser can include a head with an attachment mechanism for attaching to a known plunger, and one or more receptacles for receipt of treatment chemicals. Furthermore, the receptacle may be an elongate chamber having lower ports and upper ports. In a preferred embodiment, a valve is associated with the lower ports to control flow of liquid through the lower ports.

Alternatively, the valve may be a flexible polymeric sheet which is pressed against the lower ports as the dispenser falls through the wellbore and liquid. When the dispenser comes to rest at the bottom of the wellbore, the flexible sheet will fall away from the lower ports of the dispenser, opening the lower ports to liquid flow so that the chemical within the dispenser can be dissolved into the liquid.

Also, the dispenser may include an extension or standoff section which allows the receptacle holding the treatment chemical to be positioned below the lower end of the tubing when the plunger assembly comes to rest at the bottom of the well. This allows the treatment chemical to dissolve or diffuse into the liquid located in the near wellbore area, thereby increasing the efficiency of the chemical delivery.

In another aspect, the treatment chemical, foaming agent, surfactant and/or lubricant may be applied or recharged with a chemical application apparatus. The chemical application apparatus is a modification to wellhead manifold systems used in plunger lift operations. In this embodiment an applicator is positioned in the section of the manifold which receives the delivery system, e.g., plunger, or plunger/dispenser apparatus, or plunger with attached chemical dispenser. The applicator is positioned such that it will be operatively adjacent to the receptacle portion of the plunger, plunger/dispenser or chemical dispenser attached to a plunger. The nature of the applicator can vary depending upon the form of the treatment chemical and/or foaming agent.

The automated application of foaming agents and/or treatment chemicals to the delivery system is especially suited to the application of gels and paste. In these applications, the applicator can include a nozzle which communicates with an opening in the manifold and is aligned such that it delivers the desired materials to the desired portion of the plunger or plunger/dispenser. The nozzle can be connected to one or more storage tanks via one or more conduits. One or more control valves to control the flow of materials from the one or more storage containers to one or more nozzles can be provided.

The treatment chemical foaming agent, surfactant and/or lubricant can also be recharged by removing the delivery system from the manifold and recharging manually. This method can be used for any form in which the treatment chemical, foaming agent, surfactant and/or lubricant is used, such as, stick, time release capsules, gel, paste, putty, liquid, emulsion, etc.

DETAILED DESCRIPTION

For purposes of background, an abbreviated discussion of the plunger lift technique will be presented. Those skilled in the art will recognize that there are many variations which have been used in connection with the lift technique and system which is described. While the discussion will focus on gas producing plunger lift wells, the method of the present invention is also suited for use on oil producing wells, and can be modified for variations of the described lift system. Further, those skilled in the art will appreciate that the present invention need not be used to the exclusion of other chemical treatment methods. Costs and other considerations can result in the use of the present invention together with other treatment methods.

With reference to FIG. 1, the gas well 17 will have a wellbore 10 located within petroleum-bearing formation 11 and which typically contains a casing 12 either throughout the entire well or a portion of the wellbore. Extending through a portion of the formation 11 are fractures 15 created by known well stimulation techniques. The wellbore 10 can also contain tubing 14 within the casing 12. Typically, casing 12 will have one or more perforations 13 which provide a fluid passage between the inside of casing 12 and formation 11. In a typical arrangement, the well production will flow through the tubing 14 to the wellhead 16. For gas lift operations the tubing 14 can be provided with a stop 18 and seating nipple 19 at the lower end of the tubing 14, and a plunger 20 which travels in the tubing 14, and to the wellhead 16. In a typical arrangement, a manifold 22 is provided at the wellhead 16 which can have a plunger catch 30 to hold the plunger in place, a lubricator 32, and a control box 34 to control the flow of gas and liquid from the well by operating the valves 24, 26, 28 and 250 and related conduits.

Stop 18 is provided to prevent plunger 20 from falling below the position of the stop 18. The stop 18 can include a spring 36 or other shock absorbing device to reduce the impact of the falling plunger 20. The plunger 20 can be of any of the numerous designs which are known in the art or another delivery system as described herein. The plunger 20 provides a mechanical interface between the gas 38 and the liquid 40 present in the well. After shutting the well off at the surface, plunger 20 is allowed to fall to the bottom of the well and rest on the stop 18. After pressure builds in wellbore 10, well 17 is opened and the pressure will push plunger 20 and liquid 40 on top of plunger 20 up the tubing 14 to the surface.

When plunger 20 reaches the top of well 17 it enters or is received by manifold 22. Manifold 22 can include a shock absorbing spring 42 or other mechanism to reduce the impact of the plunger. A plunger arrival sensor 41 is provided to detect arrival of the plunger 20 at the surface and to activate plunger catch 30 which holds the plunger 20 until a signal is received to release plunger 20. Control box 34 contains circuitry for opening and closing the appropriate valves 24, 26, 28, and 250 during the different phases of the lift process. As known in the art, other valving/piping arrangements may be constructed to accomplish the same functions. By controlling these valves, control box 34 regulates the plunger lift cycle and the application of various materials such as treatment chemicals, surfactants, or lubricants, and, in the present invention, a foaming agent, to the plunger. Furthermore, once arrival sensor 41 signals control box 34 that plunger 20 has been caught by plunger catcher 30, appropriate materials may be applied to plunger 20 and/or dispensers 65 (FIG. 3), 116 (FIG. 6), 140 (FIG. 8), 162 (FIG. 9), and 220 (FIG. 14) attached to plunger 20. Following application of chemicals, control box 34 may also release plunger 20 according to its control method.

The present invention is suitable for use with any known plunger lift system, although in a preferred embodiment, brush or pad plungers are used. FIGS. 2A, 2B, and 2C illustrate several prior art plungers, although they are not intended to be all inclusive. Necks 46 are provided in most plungers to provide an area where the plunger can be caught by the plunger catcher, and also to provide an area which may be engaged by a downhole tool in the event the plunger becomes stuck in the tubing. Furthermore, many plungers are provided with a mechanical cleaning apparatus 47 suitable to engage with the walls of the tubing 14. FIG. 2A illustrates a brush plunger 48. Brush plunger 48 is also provided with necks 46 at each end. In this type of plunger, mechanical cleaning apparatus 47 is brush 50 which may be a flexible nylon brush, a metal fiber brush or a brush made from any other suitable material. FIG. 2B illustrates a solid bar stock plunger 52. In the bar stock plunger, mechanical cleaning apparatus 47 is a plurality of helical grooves or ridges 54 along a portion of bar stock plunger 52. FIG. 2C illustrates a pad plunger 56 in which mechanical cleaning apparatus 47 is pads 58 which are made up of pad plates 60. The pad plates 60 can be spring loaded so that they expand or contract to maintain contact with the inside of the tubing. The illustrated pad plunger 56 is a two-pad plunger but pad plungers can have one or more pads. The illustrated pad plunger 56 has a neck 46 at the top. However, a neck can also be provided at the opposite end. Each plunger has one or more interface sections 62 which are the portions of the plunger designed to interface with the inside of the tubing.

Referring now to FIG. 3, there is shown another embodiment of a delivery system 64 for chemicals. Only a portion of the plunger 20 is shown. The system 64 is a plunger 20 with an attached chemical dispenser 65. For purposes of illustration, this is only one embodiment of a chemical dispenser 65. The plunger 20 can be of any known design which has a neck 46 on the lower end. In this embodiment, chemical dispenser 65 has a head portion 66 and a member 68 which defines a receptacle 70 for receiving treatment chemical 72. Head 66 defines an opening 74 to receive the lower portion of plunger 20 and the plunger neck 46. Head 66 includes an attachment mechanism for attaching the dispenser 65 to plunger 20. For purposes of illustration only, two different attachment mechanisms are shown in FIG. 3. One attachment mechanism can be set screw 76 in threaded passageway 78 in head 66. Alternatively, another attachment mechanism can be a spring loaded bolt 80 in passageway 82. A spring 84 biases the bolt 80 against the neck 46 of the plunger 20. A ridge 86 can be provided in the passageway 82 against which the spring 84 rests. To remove head 66, bolt 80 or screw 76 is retracted depending on the attachment mechanism present. Typically, more than one of the same attachment mechanisms will be used to attach dispenser 65 to plunger 20, for example, one or more set screws 76, or one or more bolts 80 will be used.

The chemical dispenser 65 should securely attach to plunger 20. In some applications it may be desirable for the chemical dispenser 65 to have some play in the connection between the plunger 20 and the chemical dispenser 65 to permit a slight wobble. Some operators may prefer a more rigid fit, in which case, a portion of the upper surface 90 of head 66 can be a shaped surface which mates with a corresponding surface 92 on the plunger 20 so as to limit the movement of the plunger with respect to the dispenser. In a preferred embodiment, one or more upper ports 94 are provided, and one or more lower ports 96 are provided. Upper ports 94 allow gas and liquid to enter or leave the receptacle 70. While the plunger is falling in the tubing the primary function of ports 94 is to exhaust any gas and liquid which may enter the receptacle to aid the fall of the plunger. Once the plunger has reached the stop at the bottom of the tubing the upper ports 94, if below the liquid level, will function to allow chemical contained in the receptacle to diffuse or dissolve into the liquid. Lower ports 96 allow liquid to enter and leave the receptacle 70. In the illustrated embodiment, the lower ports 96 are on the bottom surface of member 68; however, they can also be positioned on the side walls. Preferably, a valve 98 is provided. In the illustrated embodiment, valve 98 is a flexible rubber sheet 100 having a dimension sufficient to cover lower ports 96. Valve 98 is held in place by a retaining plug 102 which can extend through an opening 104 in the bottom of the member 68. The purpose of valve 98 is to either restrict or close off the flow of liquid through lower ports 96 as the plunger drops. As the plunger drops in the tubing, the flexible sheet 100 will be pushed against the bottom of the member 68. This will either completely seal or partially seal off ports 96. The purpose of valve 98 in this embodiment is to minimize or prevent the flow of fluid through receptacle 70 while the system drops in the tubing. This will prevent or minimize the washing of chemicals out of the receptacle as the chemical dispenser 65 passes through the fluid above the stop of the tubing. Once the delivery system 64 comes to rest on the stop, flexible sheet 100 will fall away from the bottom of member 68 and to a second position 103 (shown in phantom), because there is no force pushing the flexible sheet 100 against the bottom of member 68. This will allow liquid to enter receptacle 70 and leach the treatment chemical 72 out of receptacle 70.

FIG. 3 illustrates an embodiment in which a threaded surface 106 on the bottom of head 66 is provided to engage a threaded surface 108 on member 68. Threaded surface 108 allows member 68 to be removed from head 66 which facilitates the manual insertion of chemicals into the receptacle 70. As an alternative, head 66 and member 68 can be one piece and an opening 110 provided through which chemicals can be inserted into the receptacle 70. In an alternative embodiment, dispenser 65 may receive treatment chemical 72 through passageway 73 (shown in phantom) which passes through plunger 20 and head 66.

Figure 4:
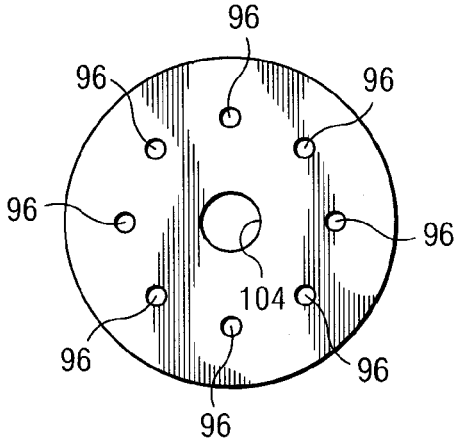
FIG. 4 is a cross-sectional view along line 4-4 of FIG. 3.

FIG. 4 is a cross sectional view of FIG. 3 across line 4-4. It illustrates a plurality of lower ports 96.

Figure 5:
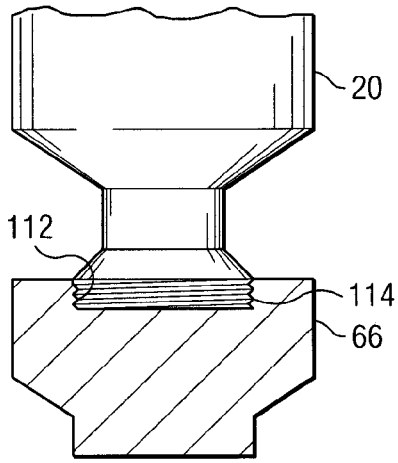
FIG. 5 is a partial cross-sectional view showing one embodiment of an attachment mechanism between a chemical dispenser and a plunger.

FIG. 5 shows another attachment mechanism for attaching the plunger 20 to head 66. In this embodiment, the lower portion of the plunger has a male threaded surface 112 and head 66 is provided with a corresponding female threaded surface 114. This allows the head 66 to be attached to plunger 20. Many other connection mechanisms can be used other than those illustrated herein.

Figure 6:
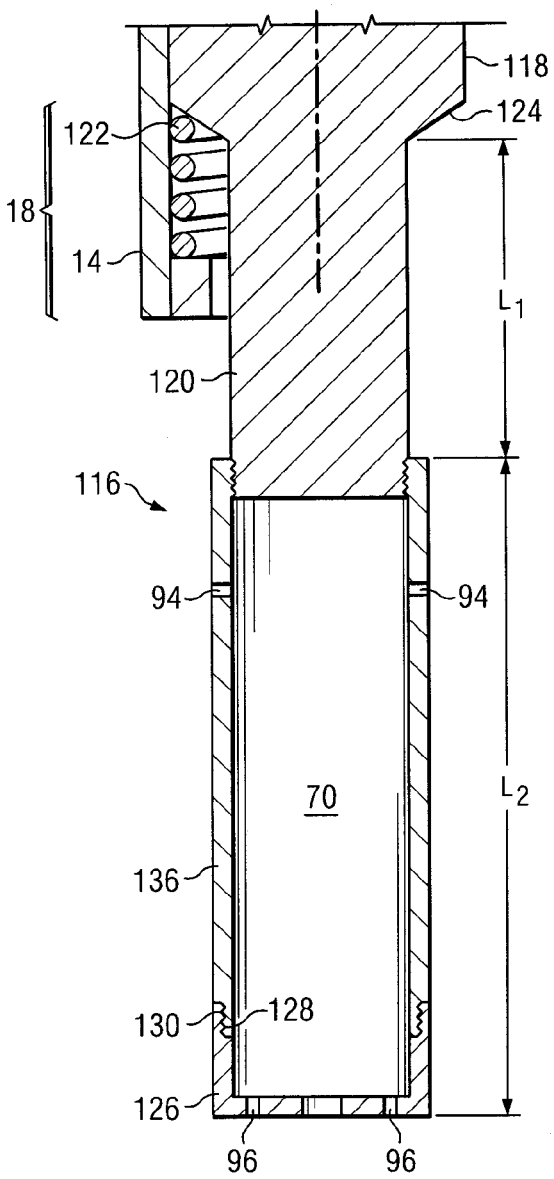
FIG. 6 is a partial cross-sectional view of another chemical dispenser removably attached to a plunger.

FIG. 6 is a partial view of a chemical dispenser 116. In this embodiment, a cap 126 having a threaded surface 128 for engaging threaded surface 130 of the wall defining the receptacle 70 is provided. In this embodiment, between head 118 and receptacle section 70 is standoff section 120. Standoff section 120 has the length $L_1$ and receptacle section 70 has a length $L_2$. For purposes of illustration, only one side of tubing 14 is shown together with stop 18. In this illustration stop 18 includes a shock absorbing spring 122 which absorbs the impact of the delivery system. Head 118 is provided with a surface 124 which contacts spring 122 of stop 18. Standoff section 120 has a sufficient length to allow the receptacle 70 to be positioned below the lower end of tubing 14. This is advantageous because it allows the chemicals in the receptacle to diffuse in the wellbore below the tubing, rather than diffusing inside the tubing. Generally, the treatment of formation 11 will be more effective when the chemical diffuses directly into the space below tubing 14. Preferably, the chemical dispenser 116 is dimensioned such that at least a portion of it will pass through the stop. An advantage of the present invention is that the assembly can be constructed to place the dispenser at a predetermined location in relation to the stop. Pressure drop occurs across the stop during well operation, and this pressure drop can produce temperature and pressure changes which cause scale deposits to form in the stop. If scale deposits are allowed to build up at the stop, the deposits can become great enough to cause the plunger to become stuck in the stop. If this occurs, it may be necessary to use wireline removal techniques, or a rig to pull the tubing. With the present invention, treatment chemicals are delivered and concentrated in the vicinity of the stop, and thus scale formation can be very effectively treated. Indeed, the dispenser can be configured to come to rest within the stop for treatment of scale, and later reconfigured to add in the standoff section to provide treatment below the stop.

Figure 7:
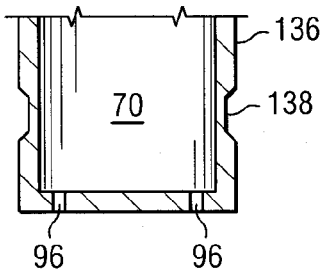
FIG. 7 is a cross-sectional view of the lower portion of a chemical dispenser.

FIG. 7 shows the lower portion of wall 136 of another embodiment of a chemical dispenser having an area of reduced outer diameter to provide neck 138. This provides an area which can be engaged by the plunger catcher on the surface.

Figure 8:
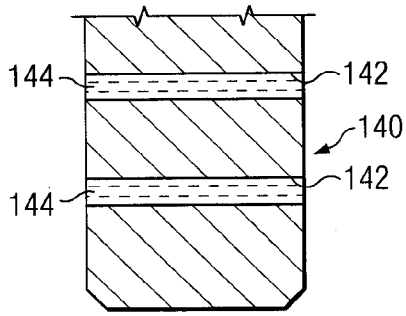
FIG. 8 is a partial cross-sectional view of the lower portion of another embodiment of a chemical dispenser.

FIG. 8 shows the lower portion of another embodiment of a chemical dispenser 140. In this embodiment, receptacles for treatment chemical in the form of one or more passageways 142 are shown. Chemical sticks 144 can be inserted into the receptacles, or the passageways 142 can be packed with chemical in a paste form or other form.

Figure 9:
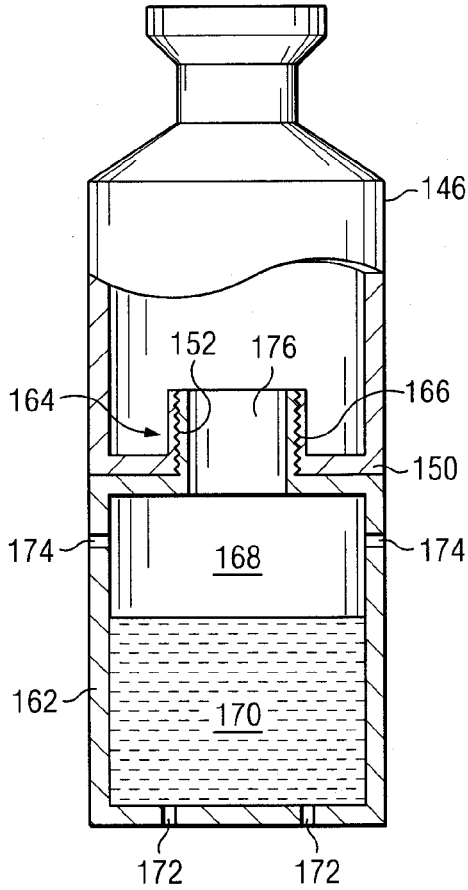
FIG. 9 is a cross-sectional view of another chemical dispenser removably attached to a plunger.

FIG. 9 shows an embodiment of plunger 146 which does not have a neck at the lower end, but rather has an annular end 150 which has an inside threaded surface 152. The chemical dispenser 162 is a tubular member having a reduced diameter portion 164 at the top which has threads on its outside surface 166 for engaging the threaded surface 152 of plunger 146. Dispenser 162 defines a receptacle 168 for holding chemical 170. The plunger has lower ports 172 and one or more upper ports 174. To manually load the dispenser 162 with chemicals, the dispenser 162 is removed from the plunger 146 and the chemicals are inserted through the opening 176 at the top. If desired, such an assembly can also be equipped with a valve to restrict flow into the lower ports. Alternatively, as further described herein, an automatic chemical applicator may be used to recharge chemicals.

Figure 10:
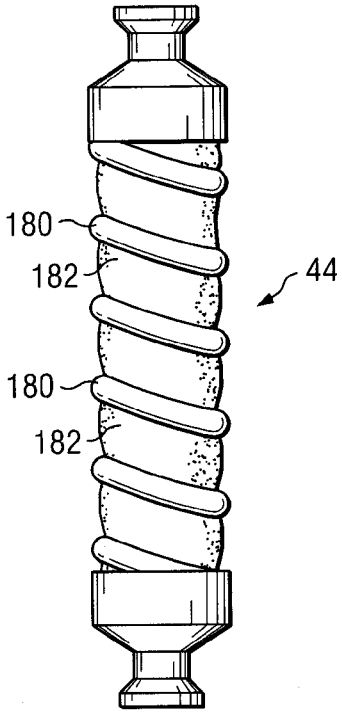
FIG. 10 is a side view of a coiled spring plunger with treatment chemical applied.
Figure 11:
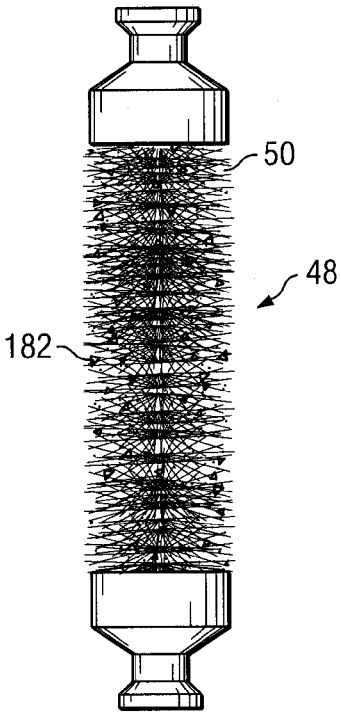
FIG. 11 is a side view of a brush plunger with applied chemical treatment solution.

FIGS. 10 and 11 illustrate yet other embodiments of plunger/chemical dispensers. These embodiments use known plungers as carriers for the chemicals. FIG. 10 illustrates a coiled spring plunger 44. In this embodiment of the invention, the space between coiled spring 180 of plunger 44 is partially or completely filled with chemical 182. In FIG. 11, a brush plunger 48 is shown. Brush 50 of brush plunger 48 may be advantageously sized such that it engages the inner surface of tubing 14. By engaging this surface, brush 50 is able to evenly and effectively distribute chemicals along this inner surface of tubing 14. In this embodiment of the invention, brush 50 of plunger 48 is impregnated with chemical 182. In this embodiment, chemical 182 can be applied in the form of a spray, paste, or gel. Preferably, it has a consistency which will allow it to be retained on brush 50 as brush plunger 48 falls through tubing 14. Chemical 182 may be any one or more of the materials discussed herein, such as treatment chemical, foaming agent, surfactant and/or lubricant. The embodiments of FIGS. 10 and 11 have the advantage of utilizing existing plungers as the delivery system. This embodiment allows for the delivery of chemical along the tubing to prevent or minimize paraffin deposit and build up, as well as physically scraping off some of the paraffin.

Figure 15:
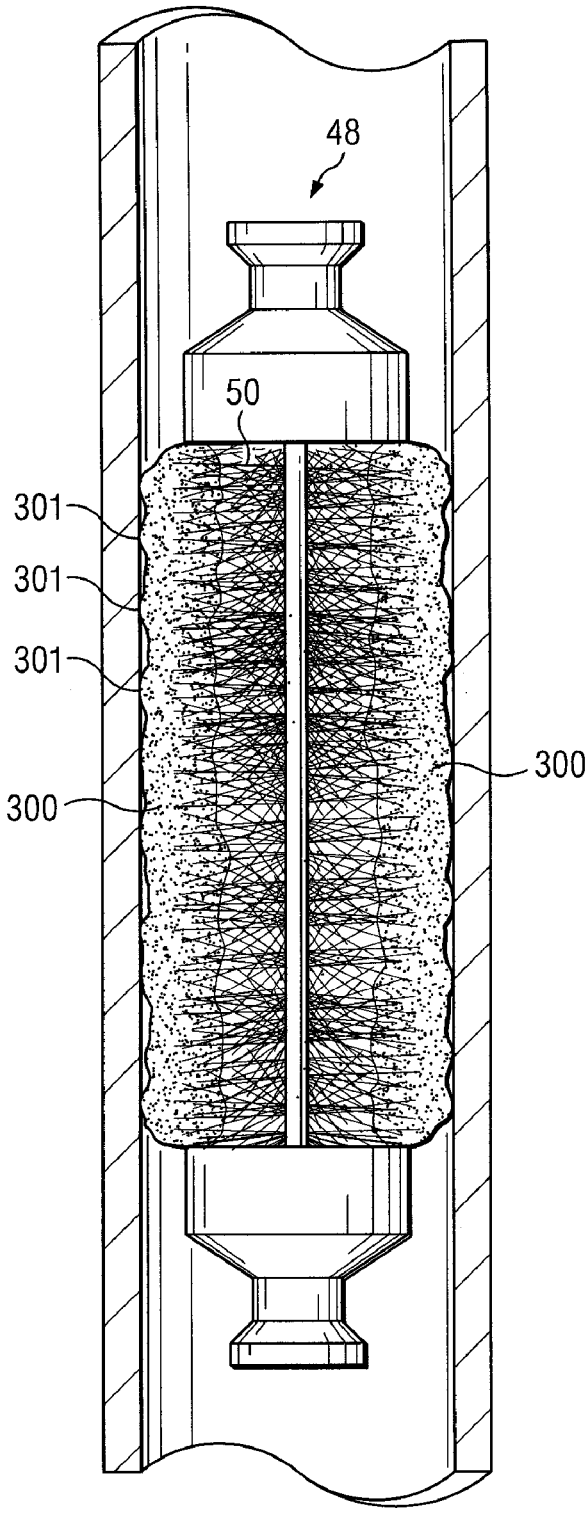
FIG. 15 is a side view of a brush plunger with foam and a chemical seal in the well tubing.

Turning to FIGS. 11 and 15, a preferred embodiment wherein plunger 20 is a brush plunger 48 is depicted. Brush plungers 48 are especially suited to the creation of foam 300 and chemical seal 301 of the present invention, although other types of plungers will be able to create foam 300 and will benefit from chemical seal 301. In the case of a brush plunger 48, the individual bristles of brush 50 mechanically agitate chemical 182, which in this embodiment is preferably a foaming agent, applied to plunger 48 to aid in the creation of foam 300, and chemical seal 301 as brush plunger 48 travels up and down within tubing 14. Foam 300 advantageously creates chemical seal 301 between brush plunger 48 and the tubing 14 in which it operates.

Foam 300 and chemical seal 301 are created by the movement of brush plunger 48 relative to the produced gas 38 and liquid 40 as well as through physical contact with the foaming agent 182 all within tubing 14. In addition to foam 300 formed by gas 38 rising through liquid 40 as brush plunger 48 settles within tubing 14, as brush plunger 48 moves up tubing 14, driven by pressure within formation 11, gas bubbles will tend to rise along with it, generally at a rate that is greater than the rate at which plunger 48 is rising. Simultaneously, liquid 40 resists the push of plunger 48, and attempts to flow back down tubing 14. It is the opposing motions of gas 38 and liquid 40, when mixed with foaming agent 182, and agitated by brush 50, that creates foam 300 and chemical seal 301.

In another embodiment of the present invention, chemical 182 may be a surfactant, lubricant, foaming agent or some combination of the three. In this embodiment, when chemical 182 includes a surfactant or lubricant, the surfactant or lubricant will act to reduce the amount of friction between the plunger 20 and tubing 14.

In yet another embodiment, in addition to chemical 182 which may be a foaming agent, an additional treatment chemical 72 may be applied either to plunger 20, or to a plunger 20 with chemical dispenser 65. Once plunger 20 or plunger 20 with chemical dispenser 65 has been released into tubing 14, it will fall to the bottom of well 10 where it will encounter liquid 40. Treatment chemical 72 is then released into liquid 40, properly diluting it. As plunger 20 subsequently rises to the top of tubing 14, foam 300 will be created. Plunger 20 with foam 300 will force liquid 40, now mixed with the diluted treatment chemicals 72, ahead of it. Because foam 300 reduces the amount of liquid 40 which flows around plunger 20 and back down tubing 14, more treatment chemical 72 is forced through tubing 14, and because there is less flow back around plunger 20, less of the diluted treatment chemical will be prematurely washed from tubing 14. As a result, foam 300 increases the likelihood that treatment chemical 72 is delivered to tubing 14 at a more consistent rate, improving the efficacy of the cleaning mechanism and reducing the amount of treatment chemical 72 required.

Figure 12:
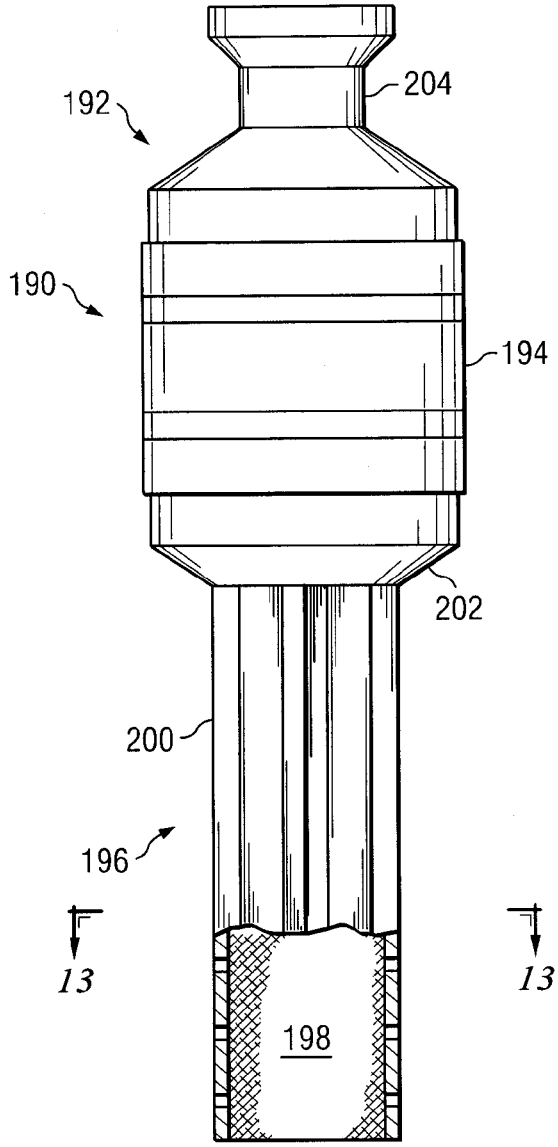
FIG. 12 is a side view of a plunger with a chemical dispenser attached.
Figure 13:
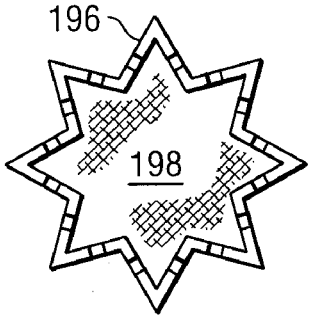
FIG. 13 is a cross-sectional view of FIG. 12 along line 13-13.

FIG. 12 illustrates plunger/dispenser 190. Previous embodiments discussed related to a chemical dispenser to be attached to a known plunger and a modification of the known plunger by the application of treatment chemicals known to be useful in the treatment of scale or skin damage near the wellbore 10. FIG. 12 relates to an embodiment of a plunger/dispenser in which the device is specifically configured to be both a plunger and a chemical delivery system. The assembly has an upper portion 192 which includes an interface section 194. The interface section is that portion which is adjacent to the inside wall of tubing 14. The interface section may be a coiled spring, a brush, pads, wobble rings or other known interface sections. The interface section fits inside the tubing snugly. When the pressure is released from the well and the plunger travels to the surface, the interface section, with foam 300, serves to retain much of the fluid above the plunger so that it may be pushed out at the well head. Below the interface section is the lower section 196. The lower section 196 can include any type of receptacle 198 to receive treatment chemicals 72, such as an absorbent pad or matrix, or other suitable structure as described above. In the illustrated embodiment, the receptacle 198 is a stiff wire mesh, and treatment chemical 72 has been deposited in the interstices between the mesh. A lower port (not shown) can be provided at the bottom, and a series of ports (not shown) can be provided along the length of lower section 196. Thus lower section 196 defines a receptacle having one or more upper ports and one or more lower ports. This embodiment also has a standoff section 200 for elongating the system such that all or a portion of the receptacle will be below the end of the stop on the tubing. The lower end of the interface section 194 is of reduced diameter to provide surface 202 for contacting stop 18. A neck 204 is provided on the top. FIGS. 13A and 13B illustrate different embodiments of a cross section of FIG. 12 along line 13-13. In FIG. 13A the cross section is a multipoint star design. This design increases the surface area of the dispenser exposed to the well liquid and provides flow paths for the liquid. In FIG. 1 3B, the cross section is circular. However, the design may take any one of a multitude of shapes although in the preferred embodiment the chemical receptacle portion 198 of the apparatus 190 is of small enough dimensions to pass through the stop 18 at the bottom of the tubing.

Figure 14:
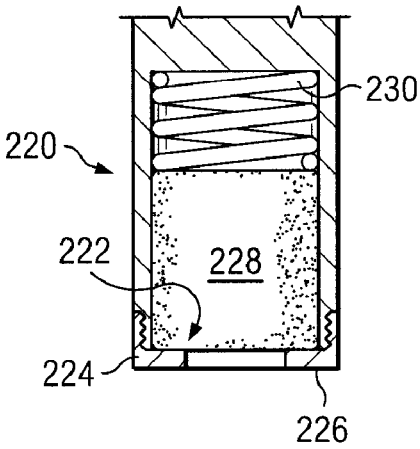
FIG. 14 is a partial cross-sectional view of a chemical dispenser.

In addition to previously described embodiments of receptacles, an additional embodiment is illustrated in FIG. 14. In the illustrated embodiment the dispenser section 220 is tubular and defines an opening 222. The opening is partially closed by a removable cap 224. The cap is annular to provide a retaining ring 226 which extends inwardly to provide a rest to retain a chemical stick 228 within the dispenser. The stick of treatment chemical is inserted into the tubular section and bias spring 230 can be provided to force the stick against the annular cap. Thus, the lower portion of the stick can be exposed to liquid at the bottom of the well and as the end dissolves the spring pushes the remainder of the stick outwardly.

Referring back to FIG. 1 in yet another embodiment of the present invention, a chemical application assembly 240 may be included. A section of conduit 242 of the manifold 22 below the lubricator 32 receives the plunger which is caught by plunger catcher 30. Plunger catcher 30 has a movable pin 244 which can engage a neck on the plunger or the delivery system. When it is desired to release the plunger the pin 244 is retracted to allow the plunger to fall. Designs and construction of plunger catchers and automatic plunger controls are well known in the art.

Figure 17:
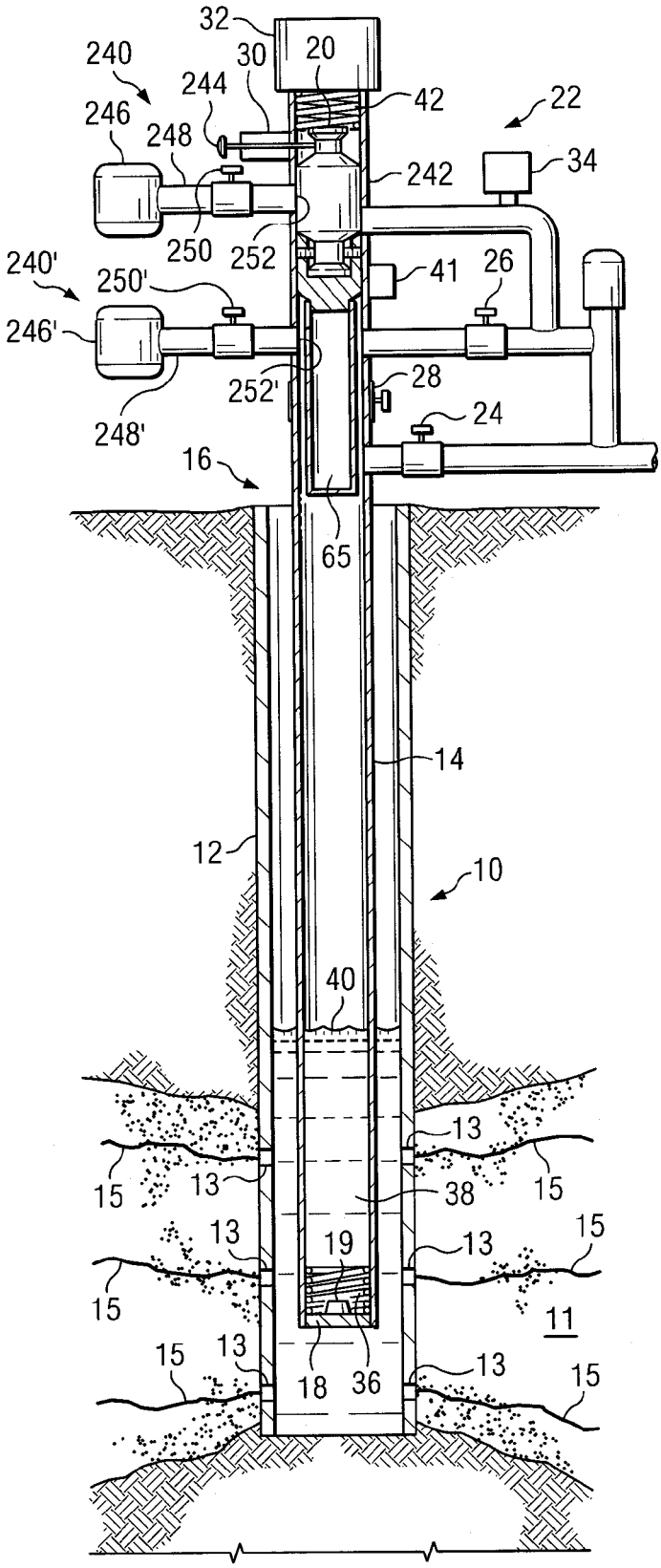
FIG. 17 is a cross-sectional area of a well with an alternate embodiment of the present invention shown.

Chemical application assembly 240 includes a chemical storage reservoir 246 which is connected by conduit 248 to a valve 250 which is connected to applicator 252. Applicator 252 can be a nozzle, an open end of conduit, or other device. The selection of the specific applicator will be made taking into account the physical characteristics of the form of the treatment chemical. Once the receptacle section of the dispenser is aligned with the applicator, valve 250 can be opened and treatment chemical 72 or chemical 182 may be forced onto the plunger 20 or into the chemical dispenser 65. With reference to FIG. 17, an alternate embodiment of manifold 22 is shown. In this embodiment, two chemical application assemblies 240 and 240' are shown although more assemblies positioned in different locations along manifold 22 are possible. Here, chemical application assembly 240 is positioned such that it may directly interface with plunger 20 while plunger 20 is retained by plunger catch 30. Alternatively, a second chemical application assembly 240' is positioned lower on manifold 22 such that it may directly interface with chemical dispenser 65. Of course, chemical application assembly 240 may be removed leaving only chemical application assembly 240'. The specific number and position of chemical application assemblies 240 provided or used for a particular application may be determined by those skilled in the art. These embodiments are provided as examples only, and are not intended to be limiting as there are a number of alternate arrangements possible.

Any suitable mode of force can be utilized to force treatment chemical 72 or chemical 182, which as previously discussed could include other treatment chemical, foaming agent, surfactant and/or lubricant, from storage container 246 including pressurizing the storage container 246 or by pumping. However, the use of the chemical application apparatus 240 or a similar apparatus for the application of treatment chemical 72 or other chemicals 182 is not required. Alternatively, the plunger 20 and/or the plunger 20 with chemical dispenser 65 can be removed from manifold 22, inspected and the chemical agents recharged if needed.

The apparatus used to carry treatment chemical 72 into the wellbore 10, be it plunger 20, chemical delivery system 64, or any of the other embodiments disclosed herein, can be made out of any material which is suitable for use in the construction of such devices. While necks have been illustrated, any other design known in the art which allows engagement with a recovery tool or with the plunger catcher is acceptable.

The treatment chemical can be any known treatment chemical. Further, the treatment chemical can be encapsulated in time-release capsules or in water-soluble gels. Treatment chemicals which can be used include paraffin solvents, clay stabilizers, paraffin inhibitors, chelating agents, scale inhibitors, solvents, corrosion inhibitors, acid, biocides and soap. Suitable encapsulated treatment chemicals are described in U.S. Pat. No. 6,279,656 B1 entitled "Downhole Chemical Delivery System for Oil and Gas Wells." The foaming agent may be any one of a number of chemicals known to produce foam. For example, Champion Technologies of Houston, Tex. offers a number of acceptable products such as Fomatron V-41.

Figure 16:
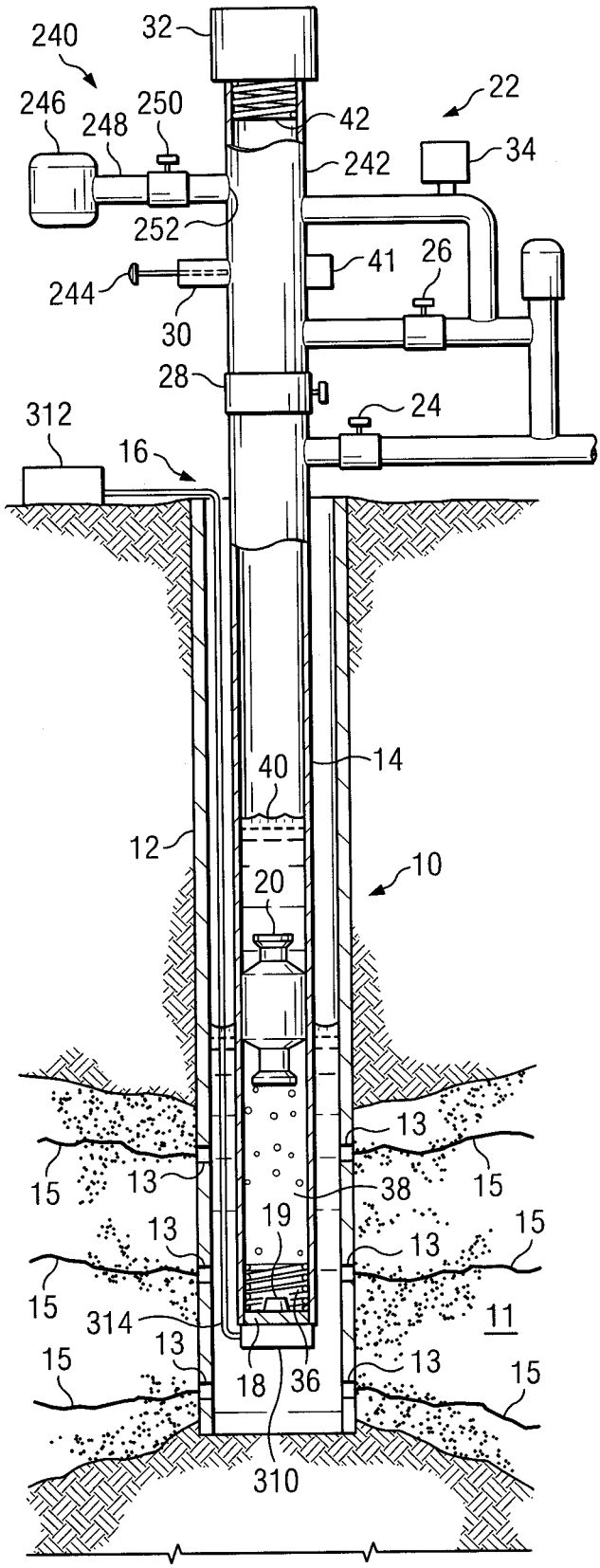
FIG. 16 is a cross-sectional area of a well with an alternate embodiment of the present invention shown.

In yet another embodiment, when the natural pressure within formation 11 is insufficient to maintain the desired volume of production due to increased loading in the wellbore, the production of oil may be enhanced by injecting gas into the produced fluids. In a gas lift technique, gas may be artificially introduced below plunger 20 to raise the pressure below plunger 20 and to aid in lifting plunger 20 and fluid 40 out of tubing 14. Turning to FIG. 16, in this embodiment, a gas lift valve 310 is placed below stop 18. Gas lift valve 310 is in fluid communication with a compressor 312 located at the surface. Compressor 312 pumps recycled gas produced from the well through conduit 314 and via gas lift valve 310 into tubing 14. Because gas lift valve 310 is placed below stop 18, the pumped gas will always be below plunger 20 and will therefore assist in lifting plunger 20 and fluid 40 out of tubing 14.

Although the invention has been disclosed and described in relation to its preferred embodiments with a certain degree of particularity, it is understood that the present disclosure of some preferred forms is only by way of example and that numerous changes in the details of construction and operation and in the combination and arrangements of parts may be resorted to without departing from the spirit of the scope of the invention as claimed here.

The invention claimed is:

1. A plunger with a chemical seal for use in a well comprising:

a plunger;

an interface section on said plunger;

one or more mechanical cleaning apparatus mounted to said interface section; and a foaming agent, wherein said foaming agent is applied to said mechanical cleaning apparatus.

2. The plunger of claim 1 further comprising a chemical dispenser, wherein said dispenser defines one or more receptacles for receiving treatment chemical.

3. The plunger of claim 1 wherein said mechanical cleaning apparatus is selected from the group consisting of brushes, pads, ridges, and coiled members.

4. The plunger of claim 3 wherein said foaming agent is applied to said mechanical cleaning apparatus such that, when said plunger is in operation, said mechanical cleaning apparatus agitates said foaming agent such that said foaming agent creates foam and a chemical seal.

5. A method for removing fluid from a well comprising the steps of:

applying a foaming agent to a plunger having a receptacle applying a treatment chemical to said plunger including the step of applying said treatment chemical to said receptacle wherein at least one of said treatment chemical and said foaming agent is applied to said plunger through a chemical applicator;

releasing said plunger into said well such that it is able to travel through said well;

causing pressure in said well to increase such that said pressure is sufficient to lift said plunger and said fluid to the surface of said well;

wherein said chemical applicator is comprised of:

a manifold which receives said plunger;

a plunger catcher connected to said manifold one or more applicators connected to said manifold, said one or more applicators having open ends positioned to apply at least one of said treatment chemical and said foaming agent to said plunger; and one or more delivery conduits connected to said one or more applicators.

6. The method of claim 5 further comprising the steps of catching said plunger with said plunger catcher at least once as said plunger travels within said well and applying at least one of said treatment chemical and said foaming agent to said plunger through said chemical applicator at least once when said plunger is caught.

7. A method for removing fluid from a well comprising the steps of:

releasing said plunger into a well;

applying a foaming agent to a plunger;

applying a treatment chemical to said plunger;

creating foam and a chemical seal around said plunger such that as said plunger, said foam and said chemical seal rise to the top of said well said fluid is removed from said well;

wherein at least one of said treatment chemical and said foaming agent is applied to said plunger through a chemical applicator, comprised of:

a manifold which receives said plunger;

a plunger catcher connected to said manifold;

one or more applicators connected to said manifold, said one or more applicators having open ends positioned to apply at least one of said treatment chemical and said foaming agent to said plunger; and one or more delivery conduits connected to said one or more applicators.

8. The method of claim 7 further comprising the steps of catching said plunger with said plunger catcher at least once as said plunger travels within said well and applying at least one of said treatment chemical and said foaming agent to said plunger through said chemical applicator at least once when said plunger is caught.

9. An apparatus for increasing oil and gas recovery in a well comprising:

a plunger, an interface section; and a foaming agent, wherein said foaming agent is applied to said interface section.

10. The apparatus of claim 9 wherein said interface section includes mechanical cleaning apparatus and said mechanical cleaning apparatus is selected from the group consisting of brushes, pads, groves, and coiled members.

11. The apparatus of claim 10 wherein said foaming agent is applied to said mechanical cleaning apparatus such that, when said apparatus is in operation, said mechanical cleaning apparatus agitates said foaming agent such that said foaming agent creates foam and a chemical seal.

12. An apparatus for delivering chemicals down a wellbore which includes a stop comprising:

a plunger;

an interface section on said body;

a chemical dispenser dimensioned so as to be able to pass through said stop;

a foaming agent; and a chemical seal.

13. The apparatus of claim 12 further comprising one or more mechanical cleaning apparatus mounted to said interface section.

14. The apparatus of claim 13 wherein said foaming agent is applied to said mechanical cleaning apparatus.

15. The apparatus of claim 12 wherein said chemical dispenser defines one or more receptacles for receiving treatment chemical.

16. The apparatus of claim 15 wherein said interface section includes mechanical cleaning apparatus and said mechanical cleaning apparatus is selected from the group consisting of brushes, pads, groves, and coiled members.

17. The apparatus of claim 16 wherein said foaming agent is applied to said mechanical cleaning apparatus such that, when said apparatus is in operation, said mechanical cleaning apparatus agitates said foaming agent such that said foaming agent creates said foam and said chemical seal.

* * * * *